US011389856B2

(12) United States Patent
Pearl, II et al.

(10) Patent No.: US 11,389,856 B2
(45) Date of Patent: Jul. 19, 2022

(54) EXPANDING TOOL AND METHOD

(71) Applicant: Uniweld Products, Inc., Fort Lauderdale, FL (US)

(72) Inventors: David S. Pearl, II, Fort Lauderdale, FL (US); Douglas B. Pearl, Hollywood, FL (US); Dragan Bukur, Fort Lauderdale, FL (US); David Foster, Plantation, FL (US)

(73) Assignee: Uniweld Products, Inc., Fort Lauderdale, FL (US)

( * ) Notice: Subject to any disclaimer, the term of this patent is extended or adjusted under 35 U.S.C. 154(b) by 150 days.

(21) Appl. No.: 16/259,077

(22) Filed: Jan. 28, 2019

(65) Prior Publication Data

US 2019/0168282 A1 Jun. 6, 2019

Related U.S. Application Data

(63) Continuation of application No. 15/613,401, filed on Jun. 5, 2017, now Pat. No. 10,226,810.

(60) Provisional application No. 62/346,767, filed on Jun. 7, 2016.

(51) Int. Cl.
*B21D 41/02* (2006.01)
*B21C 26/00* (2006.01)

(52) U.S. Cl.
CPC ..... *B21D 41/028* (2013.01); *B21C 26/00* (2013.01); *B21D 41/02* (2013.01); *B21D 41/021* (2013.01)

(58) Field of Classification Search
CPC .... B21D 41/028; B21D 41/02; B21D 41/021; B21C 26/00
See application file for complete search history.

(56) References Cited

U.S. PATENT DOCUMENTS

| | | | | |
|---|---|---|---|---|
| 943,117 | A | 12/1909 | Lucas et al. | |
| 2,711,576 | A | 6/1955 | Wilson | |
| 2,711,772 | A | 6/1955 | Wilson | |
| 3,888,102 | A | 6/1975 | Nigido | |
| 4,068,515 | A | 1/1978 | Kowal et al. | |
| 4,144,735 | A | 3/1979 | Rothenberger | |
| 4,198,844 | A | 4/1980 | Lowe | |
| 4,308,736 | A * | 1/1982 | Lowe | B21D 41/02 72/31.06 |
| 4,779,441 | A | 10/1988 | Pringle | |
| 5,272,900 | A | 12/1993 | Robbins | |

(Continued)

FOREIGN PATENT DOCUMENTS

EP 0722794 A1 7/1996

*Primary Examiner* — Matthew Katcoff
(74) *Attorney, Agent, or Firm* — Nields, Lemack & Frame, LLC

(57) ABSTRACT

A tool including a front housing and an expander head ring that is readily attachable and detachable from the front housing. The front housing may be coupled to the tool body, or can be integral with the tool body. The front housing may have a mating end that has one or more locking tabs that are configured to be engaged by the expander head ring. The expander head ring may carry one or more functional elements such as a die set that may be expanded by insertion of an expander extending from the tool such as by manual actuation of the tool. A plurality of expander head rings, each with a different size die set, can be alternatively attached to the front housing, depending on the desired extent of expanding of the pipe or the like with the tool.

3 Claims, 3 Drawing Sheets

(56) References Cited

U.S. PATENT DOCUMENTS

| | | | | |
|---|---|---|---|---|
| 5,782,128 | A | 7/1998 | Barjesteh et al. | |
| 5,918,498 | A | 7/1999 | Robbins | |
| 5,956,987 | A | 9/1999 | Anthoine | |
| 6,619,099 | B2 | 9/2003 | Barjesteh | |
| 8,869,581 | B2 | 10/2014 | Houle et al. | |
| 9,162,275 | B2 | 10/2015 | Cheng | |
| 9,943,949 | B2 * | 4/2018 | Greding | B25B 27/10 |
| 9,987,672 | B2 | 6/2018 | Houle et al. | |
| 10,226,810 | B2 | 3/2019 | Pearl et al. | |
| 2002/0043093 | A1 * | 4/2002 | Barjesteh | B21D 41/02 72/393 |
| 2006/0144116 | A1 * | 7/2006 | Buchanan | B21D 41/021 72/316 |
| 2006/0243019 | A1 * | 11/2006 | Shafer | B21D 41/021 72/453.16 |
| 2013/0133394 | A1 * | 5/2013 | Hasenberg | B21D 41/026 72/312 |
| 2013/0140739 | A1 * | 6/2013 | Lundequist | B21D 41/02 264/312 |
| 2017/0348754 | A1 | 12/2017 | Pearl et al. | |

* cited by examiner

EXPANDING TOOL AND METHOD

This application is a continuation of U.S. patent application Ser. No. 15/613,401 filed Jun. 5, 2017, which claims priority of U.S. Provisional Application Ser. No. 62/346,767 filed Jun. 7, 2016, the disclosures of which are incorporated herein by reference in their entireties.

BACKGROUND

It is often necessary to connect malleable conduits or tubing to other conduits or tubing, or to fixtures, for example. This may require that one of the free ends of the tubing be expanded, so that an appropriate coupling or seal can be made. To that end, tube expanding tools have been developed that are used to deform the malleable metal tube end. Conventionally, such tools include a cone-shaped member that is introduced into the free end of the tube to be expanded, while using a die placed around the outer portion of the tube end. Penetration of the cone-shaped member into the tube results in the expanding of the tube.

Existing tube expanding tools require manual force, such as through a leveraged screw-type tool, an impact-type tool requiring the use of a hammer, or a manual pump hydraulic hand tool. Accordingly, it would be desirable to provide a method and apparatus that forms an expanded end on malleable metal tubing that does not require significant manual force for operation, and that is easy to manufacture and use.

It also would be desirable to provide a tool that may hold one or more various other functional elements to carry out a variety of utilitarian functions.

SUMMARY

Problems of the prior art have been addressed by the embodiments disclosed herein, which in certain embodiments provide a manually operable expanding tool and a method of expanding. In certain embodiments, the expanding tool includes a front housing and an expander head ring that is readily attachable and detachable from the front housing. In certain embodiments, the front housing can be coupled to the expanding tool body, or can be integral with the expanding tool body. The front housing may have a mating end that has one or more locking tabs that are configured to be engaged by the expander head ring. The expander head ring may carry a die set that may be expanded by insertion of an expander extending from the expanding tool such as by manual actuation of the tool. A plurality of expander head rings, each with a different size die set, can be alternatively attached to the front housing, depending on the desired extent of expanding of the pipe or the like with the tool, in some embodiments, a kit is provided, the kit including an expanding tool and exchangeable expander head rings, each with a different sized die set. In other embodiments, the expander head ring may carry an element having a different functionality than a die set.

In certain embodiments, a hydraulic expanding tool is provided that includes a tool body including a hydraulic pump; a pressurizable chamber in fluid communication with the hydraulic pump; an expander positioned in the pressurizable chamber; and a front housing having an internal bore and first and second spaced locking tabs. One or more head rings, each carrying, for example, expandable die elements, may be coupled to the front housing, the head ring including a first groove for receiving the first locking tab, and a second groove for receiving the second locking tab. The locking tabs do not allow for axial adjustment of the extent to which the expander penetrates into the die set; the extent of penetration remains constant regardless of the functional element carried by the expander head ring.

In its method aspects, embodiments disclosed herein include providing an expander head ring having one or more grooves configured to slidingly receive one or more locking tabs in a front housing, coupling the expander head ring to the front housing by inserting the one or more locking tabs in the one or more grooves to fix the expander head ring onto the tool, and actuating the tool to cause the functionality attached to the expander head ring to operate, such as causing an expander to travel through the front housing and into the expander head ring to expand a die set held by the expander head ring.

DETAILED DESCRIPTION

Figure 1A:
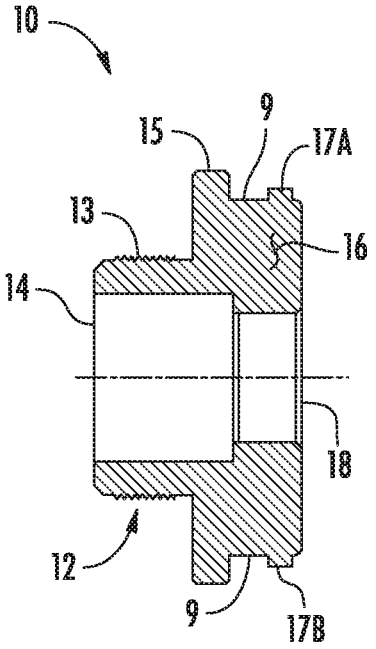
FIG. 1A is a side view, in cross-section, of a front housing of a tool in accordance with certain embodiments.

A more complete understanding of the components, processes and apparatuses disclosed herein can be obtained by reference to the accompanying drawings. The figures are merely schematic representations based on convenience and the ease of demonstrating the present disclosure, and is, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawing, and are not intended to define or limit the scope of the disclosure. In the drawing and the following description below, it is to be understood that like numeric designations refer to components of like function.

The singular forms "a," "an," and "the" include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components.

It should be noted that many of the terms used herein are relative terms. For example, the terms "upper" and "lower" are relative to each other in location, i.e. an upper component is located at a higher elevation than a lower component, and should not be construed as requiring a particular orientation or location of the structure.

The terms "top" and "bottom" are relative to an absolute reference, i.e. the surface of the earth. Put another way, a top location is always located at a higher elevation than a bottom location, toward the surface of the earth.

Turning now to FIG. 1A, in certain embodiments there is a front housing 10 which includes axially extending member 12 having an internal bore 14, the axially extending member 12 having external threads 13 for coupling the front housing 10 to a tool body. Those skilled in the art will appreciate that other ways of coupling the front housing 10 to the tool body could be used and are within the skill in the art. Alternatively, the front housing 10 could be made as an integral piece of the tool body, in which case the external threads 13 would not be required. The front housing 10 also includes an annular disc-shaped portion 15, and a cylindrical portion 16 that includes a plurality of spaced radial locking tabs 17A, 17B. In certain embodiments, there are two spaced radial locking tabs 17A, 17B, although in certain embodiments there may be additional tabs. The internal bore 14 communications with another internal bore 18 of smaller inside diameter than the internal diameter of internal bore 14. The annular region 9 between the disc-shaped portion 15 and the locking tabs 17 may accommodate an O-ring 11 (FIG. 3) or the like.

Figure 1B:
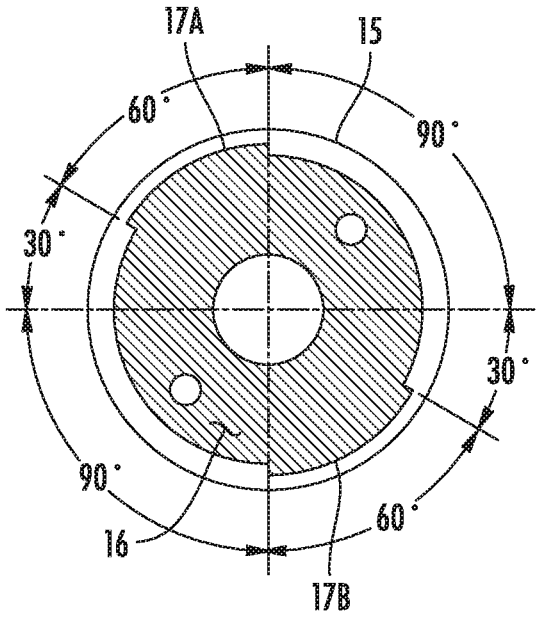
FIG. 1B is a top view, in cross-section, of the front housing of FIG. 1 in accordance with certain embodiments.

As shown in FIG. 1B, in certain embodiments the locking tab 17A extends 60° around the circumference of the cylindrical portion 16, as does the locking tab 17B. Regions each encompassing 120° that are devoid of tabs separate the locking tab 17A from the tab locking 17B. Those skilled in the art will appreciate that the aforementioned spacing of the locking tabs 17A and 17B is exemplary and that other spacings are within the scope of the embodiments disclosed herein.

Figure 2A:
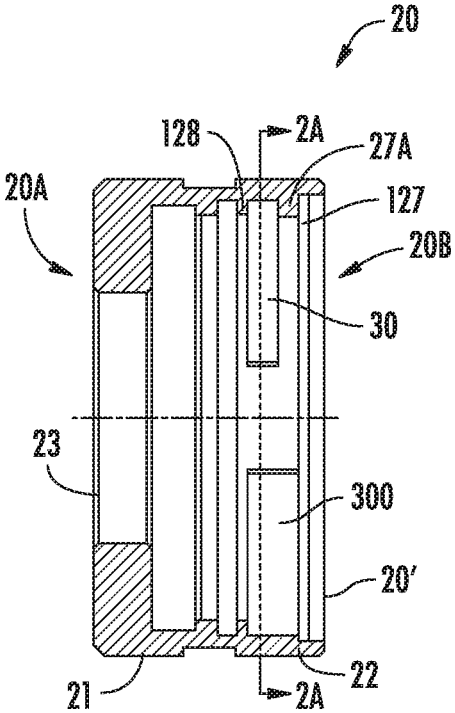
FIG. 2A is a side view, in cross-section, of an expander head ring in accordance with certain embodiments.
Figure 2B:
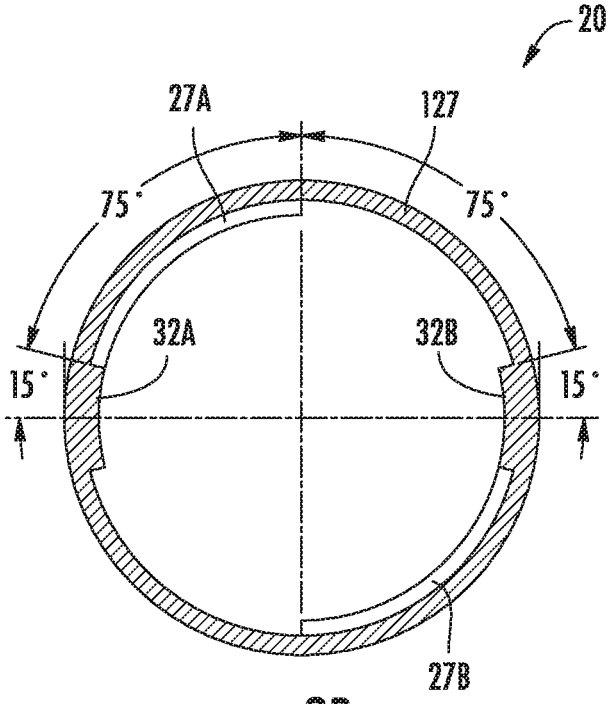
FIG. 2B is a top view, in cross-section taken along line 2A-2A of FIG. 2A, of the expander in accordance with certain embodiments.
Figure 3:
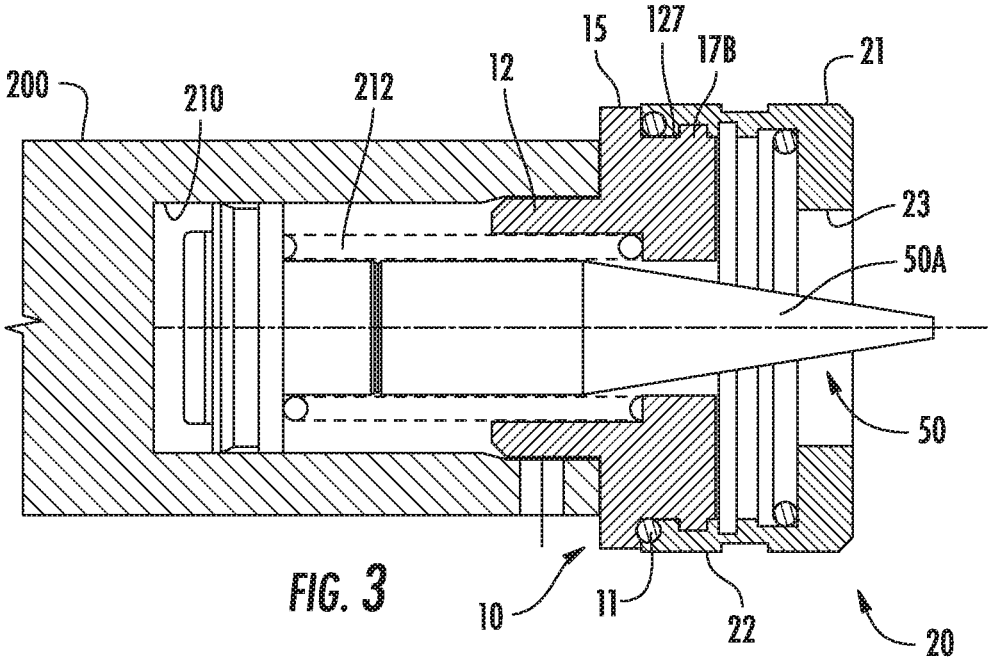
FIG. 3 is a side view, in cross-section of a tool including an expander shown in a first position in accordance with certain embodiments.
Figure 5:
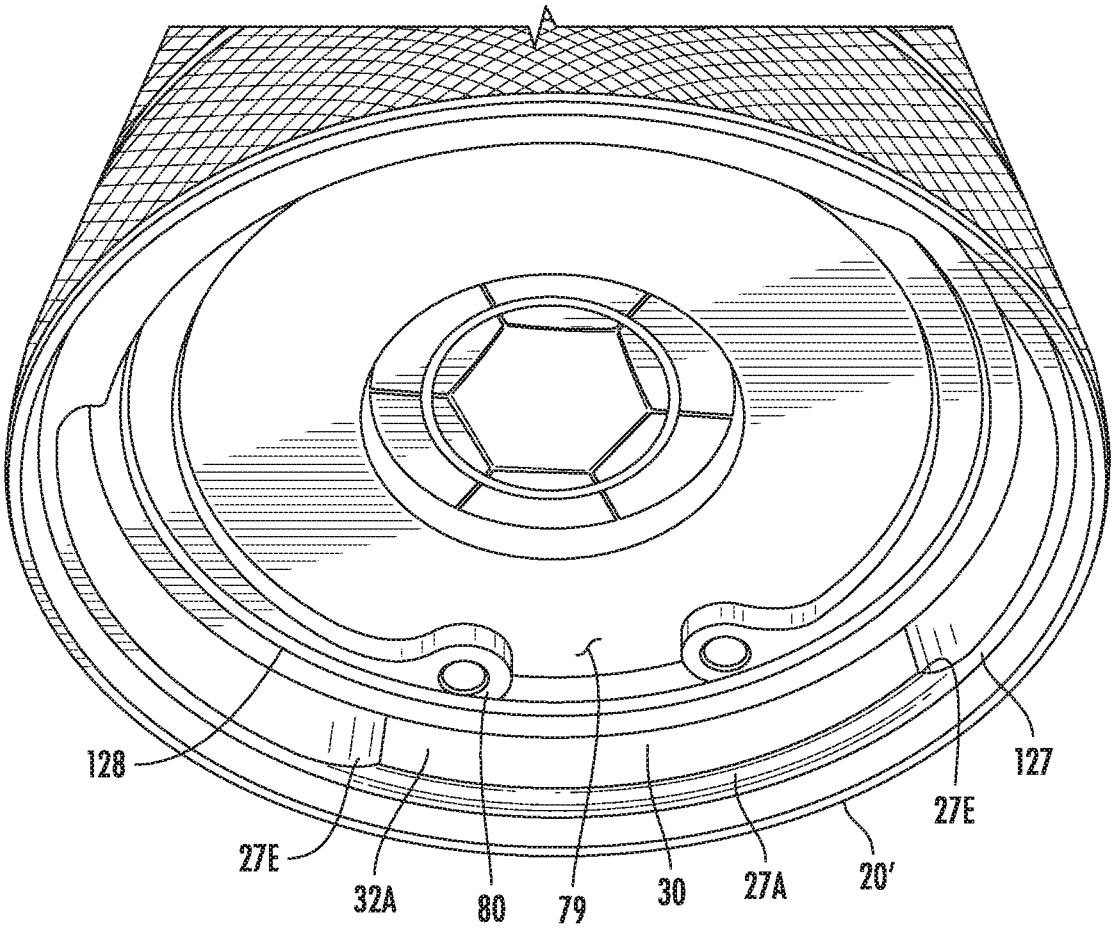
FIG. 5 is a perspective view of an expander head ring in accordance with certain embodiments.

Turning now to FIG. 2A, there is shown an expander head ring 20 in accordance with certain embodiments. The expander head ring 20 is generally cylindrical, and may include annular knurled or textured external regions 21, 22 to facilitate manual gripping of the head ring 20. In certain embodiments, the head ring 20 includes at one end an internal bore 23, configured to receive one or more functional elements such as a plurality of expander dies that extend through the bore and are positioned to receive a movable member such as a conical expander 50, for example (FIG. 3). Other suitable functional elements include those that are capable of changing the configuration of a tube or the like, such as elements for flaring and tube forming, for example. The internal bore 23 extends through the expander head ring 20, expanding in internal diameter in several steps between the smallest internal diameter at end 20A to the largest internal diameter at end 20B. As best seen in FIGS. 2B and 5, in certain embodiments the expander head ring 20 includes an annular ring 127 positioned axially inwardly of the outer edge or free end 20' at end 20B of the head ring 20, and that extends radially inwardly from the inner surface of the head ring 20. In certain embodiments, at one or more intervals along the annular ring 127, there are two spaced radially inwardly extending projections 27A, 27B. The projections 27A, 27B extend radially inwardly a distance further than the annular ring 127, and extend axially (in the direction away from the free end or edge 20') a distance further than the annular ring 127. As best seen in FIG. 5, the ends 27E of each projection 27A, 27B are ramped to gradually taper towards the annular ring 127.

In certain embodiments, a second annular ring 128 is axially spaced from annular ring 127, as seen in FIGS. 2A and 5. The space between the second annular ring 128 and projection 27A defines a first groove 30. Similarly, the space between the second annular ring 128 and the projection 27B defines a second groove 300 (FIG. 2A). Each groove 30, 300 ramps to a respective stop 32A, 32B (FIGS. 2B and 5). Each groove is configured to receive a respective locking tab 17A, 17B of the front housing 10. Thus, to assemble the front housing 10 to the expander head ring 20, the locking tabs 17A, 178 of the front housing 10 are inserted into the space between the projections 127A, 127B of the expander head ring 20, and then the expander head ring 20 and the front housing 10 are rotated with respect to each other to cause the locking tabs 17A, 17B to be slidingly received by the grooves 30, 300 until the locking tabs 17A, 17B abut against the stops 32A, 32B, fixing the expander head ring 20 to the front housing 10 and preventing any axial movement thereof.

Figure 4:
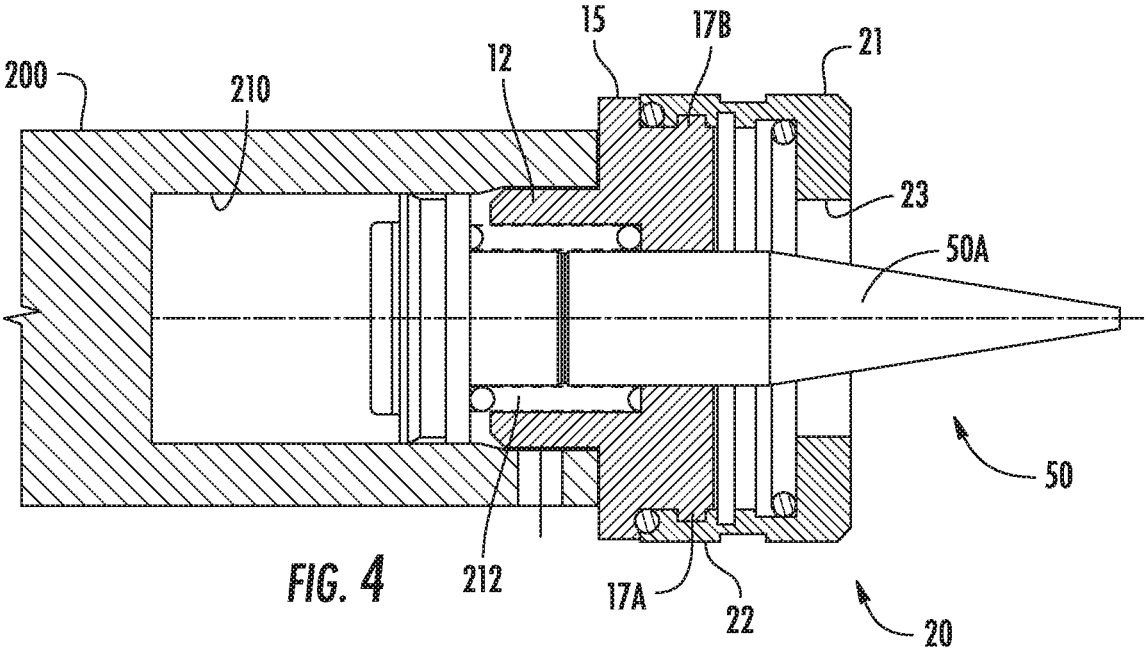
FIG. 4 is a side view, in cross-section of a tool including an expander shown in a second position in accordance with certain embodiments.

FIG. 3 illustrates the expander head ring 20 assembled to the front housing 10, which in turn is coupled to an expander tool 200 including expander 50. The expander 50 preferably terminates in a portion 50A that is shaped to engage the interior shape of die elements and expand the elements as the portion 50A penetrates that interior region. In certain embodiments, the portion 50A is conically shaped. The expander 50, as shown in FIG. 3, is in its normal unexpanded position, housed in chamber 210 of tool 200. Biasing member 212 biases the conical expander 50 to the resting position shown in FIG. 3. In certain embodiments, the chamber 210 is part of a hydraulic pump and may be pressurized by activation of the hydraulic pump such as by manual actuation of a pumping lever associated with the tool 200 as is known in the art, such as the tool disclosed in U.S. Pat. No. 6,619,099, the disclosure of which is hereby incorporated by reference. Pressurization of the chamber 210 causes the expander 50 to move, against the force of biasing member 212, to the tube expanding position shown in FIG. 4, As the expander 50 travels through the internal bore 23, it engages and radially expands a plurality of die elements of a die set (not shown) attached to the expander head ring 20, thereby expanding deformable tubing positioned on the die set.

In accordance with certain embodiments, an expanded tube is formed by clamping or otherwise coupling a tube having a tube end between a plurality of die elements attached to the expander tool 200 that are radially expandable and shaped to form an expanded tube end. The die elements may be held in place in the head ring 20 by a washer 79 and snap ring 80 or the like (FIG. 5). The head ring 20 is attached to the front housing 10 by aligning the spaces between the projections 27A, 27B with respective locking tabs 17A, 17B, forcing the locking tabs into respective grooves 30, 300, and rotating the head ring 20 with respect to the front housing 10 to cause the locking tabs 17A, 17B to be captured beneath respective projections 27A, 27B and fix the head ring 20 in place. Actuation of the tool causes the expander 50 to translate axially in the tool and travel through internal bore 14, internal bore 23, and engage the die elements and cause them to expand radially, thereby expanding the tube.

What is claimed is:

1. A method of expanding a tube with a hydraulic tool, comprising:

positioning said tube on expandable die elements of a hydraulic tool comprising:

a hydraulic pump;

a pressurizable chamber in fluid communication with said hydraulic pump;

an expander positioned in said pressurizable chamber;

a front housing having an internal bore and first and second spaced locking tabs; and a head ring for carrying said expandable die elements, said head ring comprising a first groove for receiving said first locking tab, and a second groove for receiving said second locking tab, wherein each of said first and second grooves ramps radially to a respective stop;

fixing said head ring to said front housing by inserting each of said first and second locking tabs into a respective one of said first and second grooves and causing relative rotation between said front housing and said head ring, without relative axial translation between said front housing and said head ring, thereby causing said first and second locking tabs to abut against a respective one of said first and second stops;

actuating said tool to cause said expander to translate axially in said tool through said internal bore and engage said expandable die elements causing said expandable die elements to expand, thereby expanding said tube.

2. The method of claim 1, wherein said expander comprises a conically shaped region.

3. The method of claim 1, wherein said first groove is configured and arranged to slidingly receive said first tab and said second groove is configured and arranged in said head ring to slidingly receive said second tab.

* * * * *